US010878993B2

(12) United States Patent
Tanaka et al.

(10) Patent No.: US 10,878,993 B2
(45) Date of Patent: Dec. 29, 2020

(54) INDUCTOR

(71) Applicant: Murata Manufacturing Co., Ltd., Kyoto-fu (JP)

(72) Inventors: Akira Tanaka, Nagaokakyo (JP); Tomotaka Gotoda, Nagaokakyo (JP); Sunao Noya, Nagaokakyo (JP); Hiroyuki Ukai, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 305 days.

(21) Appl. No.: 15/879,176

(22) Filed: Jan. 24, 2018

(65) Prior Publication Data

US 2018/0247754 A1 Aug. 30, 2018

(30) Foreign Application Priority Data

Feb. 28, 2017 (JP) ..... 2017-037494

(51) Int. Cl.
*H01F 27/29* (2006.01)
*H01F 27/28* (2006.01)
*H01F 17/04* (2006.01)

(52) U.S. Cl.
CPC ..... *H01F 27/292* (2013.01); *H01F 17/045* (2013.01); *H01F 27/2823* (2013.01); *H01F 27/2828* (2013.01); *H01F 27/29* (2013.01)

(58) Field of Classification Search
CPC ..... H01F 27/292; H01F 27/29; H01F 17/045; H01F 27/2828; H01F 27/2823; H01F 3/10; H01F 27/255
See application file for complete search history.

(56) References Cited

U.S. PATENT DOCUMENTS 7,612,641 B2 * 11/2009 Jean ..... H01F 27/027 336/192
9,728,320 B1 * 8/2017 Horiuchi ..... H01F 27/29
2002/0180574 A1 12/2002 Toi et al.

FOREIGN PATENT DOCUMENTS

| | | |
|---|---|---|
| CN | 1286480 | 3/2001 |
| JP | S60176517 U | 11/1985 |
| JP | H10135048 A | 5/1998 |
| JP | H10-321438 A | 12/1998 |
| JP | 2002-280226 A | 9/2002 |

(Continued)

OTHER PUBLICATIONS

An Office Action; "Notification of Reasons for Refusal," Mailed by the Japanese Patent Office dated on Jun. 4, 2019, which corresponds to Japanese Patent Application No. 2017-037494 and is related to U.S. Appl. No. 15/879,176; with English language translation.

*Primary Examiner* — Tuyen T Nguyen
(74) *Attorney, Agent, or Firm* — Studebaker & Brackett PC

(57) ABSTRACT

An inductor includes a core including a columnar shaft and a support on an end portion of the shaft, a terminal electrode disposed on the support, and a wire wound around the shaft and having an end portion connected to the terminal electrode. The terminal electrode includes a bottom surface electrode on a bottom surface of the support and an end surface electrode on an end surface of the support. The end surface electrode includes an end portion in a width direction of the end surface and a central portion in the width direction of the end surface. The central portion is positioned higher than the end portion.

20 Claims, 9 Drawing Sheets

(56) References Cited

FOREIGN PATENT DOCUMENTS

| | | | |
|---|---|---|---|
| JP | 2004-079480 | A | 3/2004 |
| JP | 2016-054262 | A | 4/2016 |

* cited by examiner

INDUCTOR

CROSS-REFERENCE TO RELATED APPLICATION

This application claims benefit of priority to Japanese Patent Application No. 2017-037494, filed Feb. 28, 2017, the entire content of which is incorporated herein by reference.

BACKGROUND

Technical Field

The present disclosure relates to an inductor that includes a wire wound around a core.

Background Art

Existing electronic devices include various inductors. A wire-wound inductor includes a core and a wire wound around the core. The wire includes end portions connected to corresponding terminal electrodes disposed on the core (refer to, for example, Japanese Unexamined Patent Application Publication No. 2002-280226 and Japanese Unexamined Patent Application Publication No. 10-321438). The terminal electrodes are connected, for example, by soldering, to a pad disposed on an object (for example, a circuit board) on which the inductor is to be mounted.

SUMMARY

As a result of progress in the size reduction of electronic devices such as cellular phones, an inductor to be mounted on such electronic devices is also required to be smaller. The size reduction of the inductor decreases the area of a terminal electrode of the inductor, resulting in a decrease in connection strength with respect to an object. Such a circumstance may lead to degradation of mounting reliability.

Accordingly, the present disclosure provides an inductor capable of suppressing a decrease in connection strength.

According to one embodiment of the present disclosure, an inductor includes a core including a columnar shaft and a support on an end portion of the shaft; a terminal electrode disposed on the support; and a wire wound around the shaft and having an end portion connected to the terminal electrode. The terminal electrode includes a bottom surface electrode on a bottom surface of the support and an end surface electrode on an end surface of the support. The end surface electrode includes an end portion in a width direction of the end surface and a central portion in the width direction of the end surface. The central portion is positioned higher than the end portion.

Such a structure increases the surface area of the end surface electrode compared with when the central portion and the end portion have the same height. The increase in the surface area strengthens connection with respect to a circuit board, that is, increases the connection strength with respect to the circuit board. Therefore, the small inductor can obtain a sufficient connection strength with respect to the circuit board as a mounting object, that is, can suppress a decrease in the connection strength.

In the inductor according to the embodiment of the present disclosure, the end surface electrode preferably includes an upper end having a substantially upward-protruding arc shape. Such a structure can further increase the area of the end surface electrode, that is, the surface area of the terminal electrode.

Regarding the end surface electrode of the inductor, the ratio of the height of the central portion in the width direction of the end surface relative to the height of the end portion in the width direction of the end surface is preferably approximately 1.1 or higher. Also, regarding the end surface electrode of the inductor, the ratio of the height of the central portion in the width direction of the end surface relative to the height of the end portion in the width direction of the end surface is preferably approximately 1.2 or higher.

Furthermore, regarding the end surface electrode of the inductor, the ratio of the height of the central portion in the width direction of the end surface relative to the height of the end portion in the width direction of the end surface is preferably approximately 1.3 or higher. Such a structure can further increase the area of the end surface electrode, that is, the surface area of the terminal electrode.

The terminal electrode of the inductor preferably further includes a side surface electrode on a side surface of the support. The side surface electrode has a height gradually increasing from an inner surface of the support toward the end surface of the support.

A magnetic flux generated at the shaft of the core due to a current flowing through the wire forms so as to flow out from the shaft and return to the shaft via the support and the air. The terminal electrode of the inductor do not obstruct the magnetic flux at most part of the side surface of the support and most part of ridge portion between the side surface and the end surface of the support; thus, a decrease in the total amount of the magnetic flux is suppressed. Suppressing the decrease in the total amount of the magnetic flux, as described above, can improve efficiency of acquiring an inductance. Moreover, since the terminal electrode does not obstruct the magnetic flux at most part of the ridge portion, occurrence of an eddy-current loss in the terminal electrode is also reduced; thus, a decrease in a Q-factor can be also suppressed. Due to the terminal electrode having a lower height on the inner surface than on the side of the end surface, interference of solder, on the side of the inner surface, with the wire and the shaft of the inductor, when the inductor is mounted, can be reduced even when the height of the end surface electrode is increased.

The length of the inductor, including the core and the terminal electrode, is preferably approximately 1.0 mm or less. The width thereof, including the core and the terminal electrode, is preferably approximately 0.6 mm or less. The height thereof, including the core and the terminal electrode, is preferably approximately 0.8 mm or less.

Such a structure can suppress a decrease in the connection strength of the small inductor including the core. The height of the inductor is preferably larger than the width thereof.

In the structure, the end surface electrode can be positioned higher relative to a fixed mounting area, and as a result, a decrease in the connection strength can be further suppressed. The inductor according to the embodiment of the present disclosure is capable of suppressing a decrease in connection strength.

Other features, elements, characteristics and advantages of the present disclosure will become more apparent from the following detailed description with reference to the attached drawings.

DETAILED DESCRIPTION

Figure 1B:
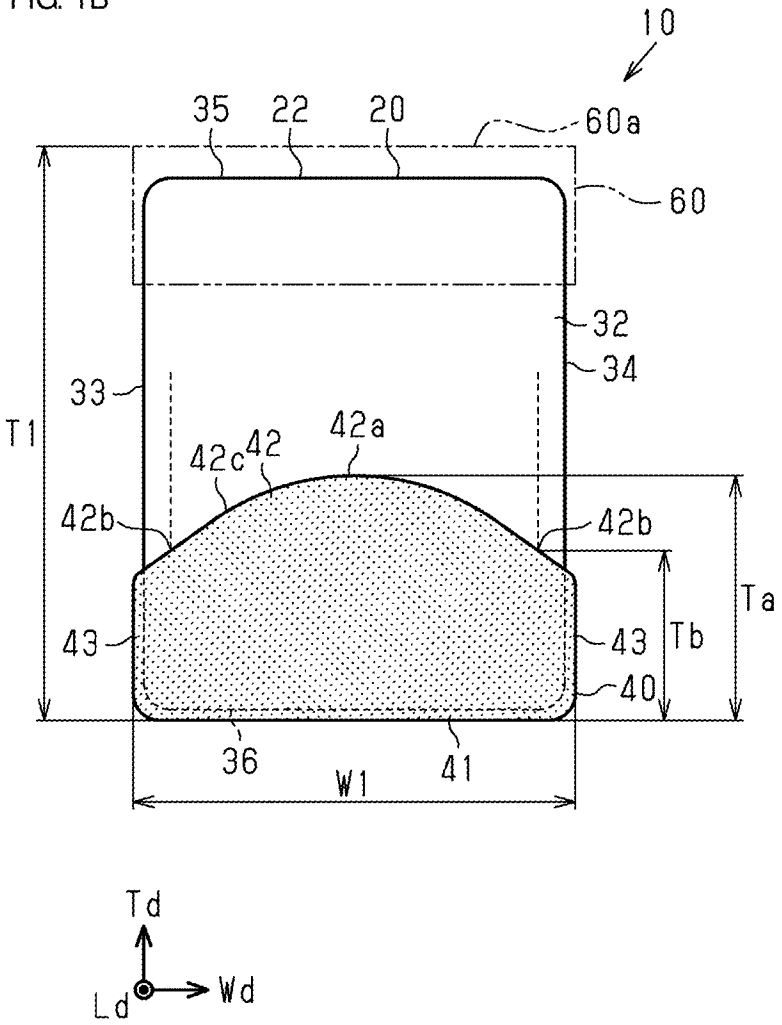
FIG. 1B is an end view of the inductor.

Each embodiment will be described below. Some accompanying drawings include enlarged views of components for easy description. The component dimension ratio in the drawings may differ from the actual component dimension ratio or may differ among the drawings.

First Embodiment

A first embodiment will be described below.

Figure 1A:
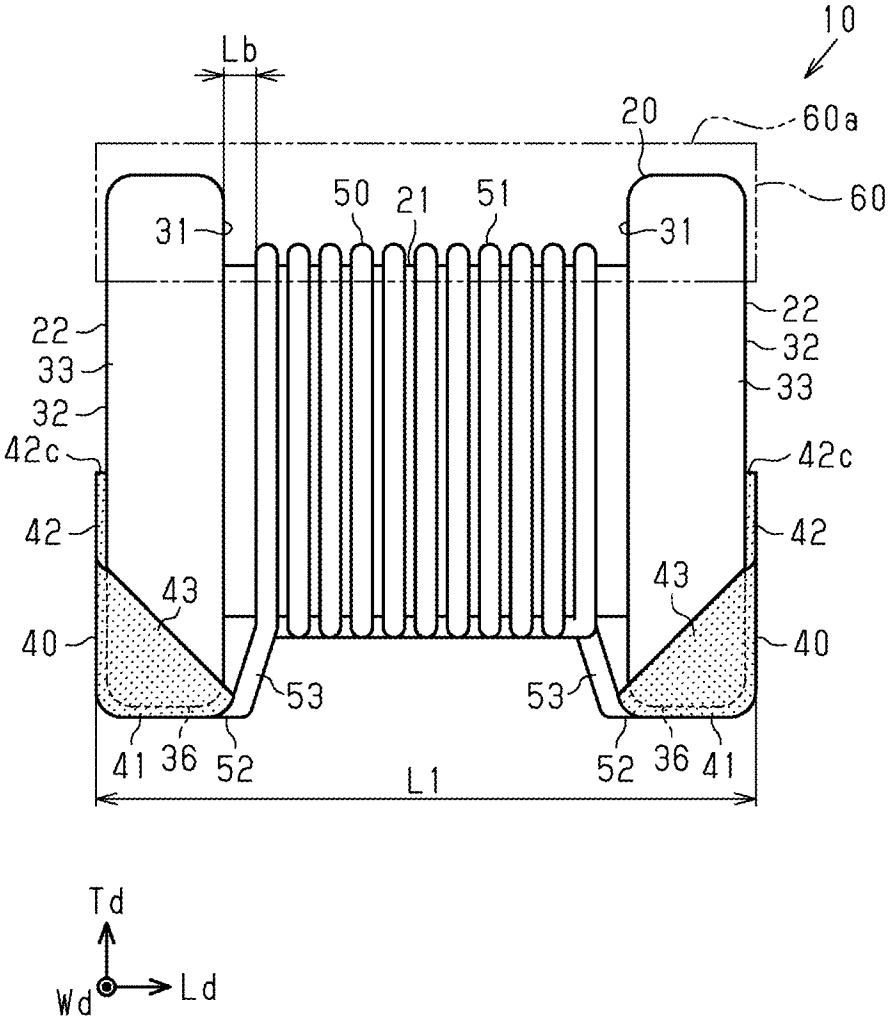
FIG. 1A is a front view of an inductor according to a first embodiment.
Figure 2:
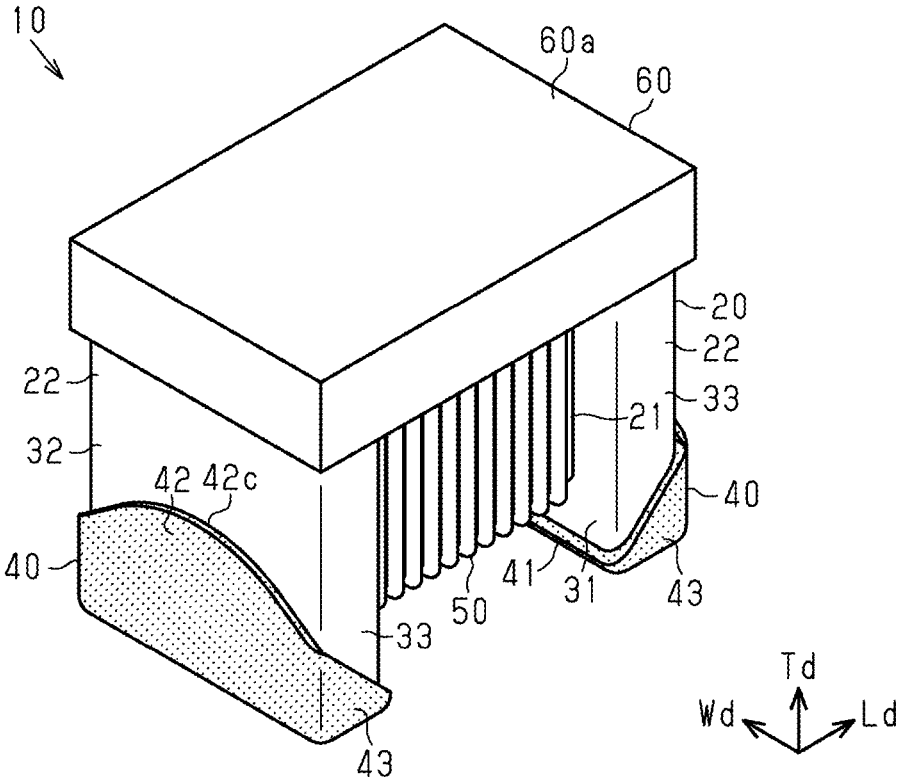
FIG. 2 is a perspective view of the inductor according to the first embodiment.

An inductor 10 illustrated in each of FIGS. 1A and 1B, and FIG. 2, is a surface mount inductor to be mounted on, for example, a circuit board. The inductor 10 is applicable to various devices, including portable electronic devices (mobile electronic devices) such as smartphones and wrist-worn mobile electronic devices (for example, a smartwatch).

The inductor 10 according to the first embodiment includes a core 20, a pair of terminal electrodes 40, and a wire 50. The core 20 includes a shaft 21 and a pair of supports 22. The shaft 21 has a substantially rectangular parallelepiped shape. The pair of supports 22 extend from respective end portions of the shaft 21 in a second direction orthogonal to a first direction in which the shaft 21 extends. The supports 22 support the shaft 21 so as to be parallel to a mounting object (circuit board). The pair of supports 22 is integral with the shaft 21.

The terminal electrodes 40 are disposed on the respective supports 22. The wire 50 is wound around the shaft 21. The wire 50 wound around the shaft 21 forms a single layer on the shaft 21. Two end portions of the wire 50 are connected to the respective terminal electrodes 40. The inductor 10 is a wire-wound inductor.

The inductor 10 has a substantially rectangular parallelepiped shape. In the present specification, the "rectangular parallelepiped" denotes a rectangular parallelepiped having chamfered corner portions and chamfered ridge portions and a rectangular parallelepiped having rounded corner portions and rounded ridge portions. Some or all of the main surfaces and side surfaces of the rectangular parallelepiped may include projections, recesses, and the like. In the rectangular parallelepiped, surfaces opposite to each other are not necessarily perfectly parallel to each other; the surfaces may incline slightly.

In the present specification, an extending direction of the shaft 21 is defined as a "longitudinal direction Ld (first direction)", a direction orthogonal to the longitudinal direction Ld and vertical in FIGS. 1A and 1B is defined as a "height direction (thickness direction) Td", and a direction (horizontal direction in FIG. 1B) orthogonal to each of the longitudinal direction Ld and the height direction Td is defined as a "width direction Wd". In the present specification, the "width direction" denotes a direction orthogonal to the longitudinal direction and parallel to the circuit board when the inductor 10 is mounted on the circuit board, that is, parallel to the circuit board on which the inductor 10 is mounted via the terminal electrodes 40.

The length (length L1) of the inductor 10 in the longitudinal direction Ld is preferably larger than approximately 0 mm and not larger than approximately 1.0 mm. The length L1 of the inductor 10 according to the first embodiment is, for example, approximately 0.7 mm.

The width (width W1) of the inductor 10 in the width direction Wd is preferably larger than approximately 0 mm and not larger than approximately 0.6 mm. The width W1 is preferably not larger than approximately 0.36 mm, and more preferably not larger than approximately 0.33 mm. The width W1 of the inductor 10 according to the first embodiment is, for example, approximately 0.3 mm.

The height (height T1) of the inductor 10 in the height direction Td is preferably larger than approximately 0 mm and not larger than approximately 0.8 mm. The height T1 of the inductor 10 according to the first embodiment is, for example, approximately 0.5 mm.

As illustrated in FIG. 2, the shaft 21 has a substantially rectangular parallelepiped shape extending in the longitudinal direction Ld. Each of the supports 22 has a plate shape that is thin in the longitudinal direction Ld. Each of the supports 22 has a substantially rectangular parallelepiped shape that is longer in the height direction Td than in the width direction Wd.

Each of the supports 22 protrudes from the periphery of the shaft 21 in the height direction Td and the width direction Wd. Specifically, each of the supports 22 viewed in the longitudinal direction Ld has a planar shape protruding from the shaft 21 in the height direction Td and the width direction Wd.

Each of the supports 22 has an inner surface 31 and an end surface 32, which are opposite to each other in the longitudinal direction Ld, a pair of side surfaces 33 and 34, which are opposite to each other in the width direction Wd, and an upper surface and a bottom surface 36, which are opposite to each other in the height direction Td. The inner surface 31 of one of the supports 22 opposes the other inner surface 31 of the other support 22. In the present specification, the "bottom surface" denotes a surface that opposes, as illustrated, the circuit board when the inductor is mounted on the circuit board. In particular, the bottom surface of a support corresponds, in both supports, to a surface on the side on which the terminal electrode is disposed. The "end surface" denotes a surface, of the support, facing the side opposite to the shaft side. The "side surface" denotes a surface adjacent to the bottom surface and the end surface.

As a material of the core 20, for example, a magnetic material (for example, nickel (Ni)-zinc (Zn) ferrite and manganese (Mn)—Zn ferrite), alumina, and a metal magnetic substance can be used. The core 20 is obtained by molding and sintering powders of these materials.

Figure 3:
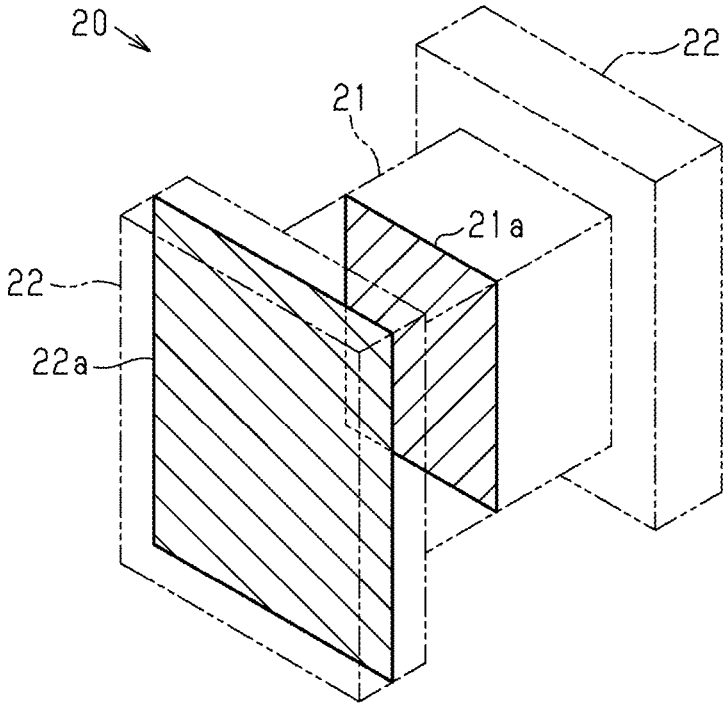
FIG. 3 is a schematic perspective view of sections of a core.

The area of a section 21*a* of the shaft 21, the section 21*a* being orthogonal to the axial direction (longitudinal direction Ld) of the shaft 21, is preferably approximately 35%-75%, and more preferably approximately 40%-70%, of the area of a section 22*a* of each support 22, the section 22*a* being orthogonal to the axial direction, as illustrated in FIG. 3. The area of the section 21*a* is further preferably approximately 45%-65% thereof and further more preferably approximately 50%-60% thereof. In the first embodiment, the area of the section 21*a* of the shaft 21 is approximately 55% of the area of the section 22*a* of each support 22.

Setting a ratio of the sectional area of the shaft 21 relative to the sectional area of each support 22 so as to fall within a predetermined range, as described above, provides, in the direction orthogonal to the longitudinal direction Ld (width direction Wd and height direction Td), a space between an end of each support 22 and the shaft 21. The use of each space increases design flexibility of the inductor 10 (core 20). For example, due to the ratio, which is larger than a certain ratio, of the sectional area of the shaft 21 relative to the sectional area of each support 22, the core 20 has increased strength. Moreover, due to the ratio, saturation of a magnetic flux that passes through the core 20 increases, and it is thereby possible to suppress degradation in characteristics of the inductor. However, when the ratio of the sectional area of the shaft 21 relative to the sectional area of each support 22 is large, the wire 50 wound around the core 20 may protrude from the ends of the supports 22.

The design flexibility includes flexible positioning of the shaft 21 with respect to the supports 22. The position of the shaft 21 determines characteristics of the inductor 10. For example, high positioning of the shaft 21 suppresses parasitic capacitance from being generated between the wire 50 and a wire or a pad of the circuit board on which the inductor 10 is mounted, and increases a self-resonance frequency. In contrast, low positioning of the shaft 21 increases, in a region above the shaft 21, the areas of the opposing inner surfaces 31 of the pair of supports 22. As a result, a magnetic flux easily forms between the pair of supports 22. Thus, it is possible to set a desired inductance, which makes a high impedance obtainable.

Each terminal electrode 40 includes a bottom surface electrode 41 disposed on the bottom surface 36 of the support 22 corresponding thereto. Each bottom surface electrode 41 extends over the entire bottom surface 36 of the corresponding support 22.

Figure 9:
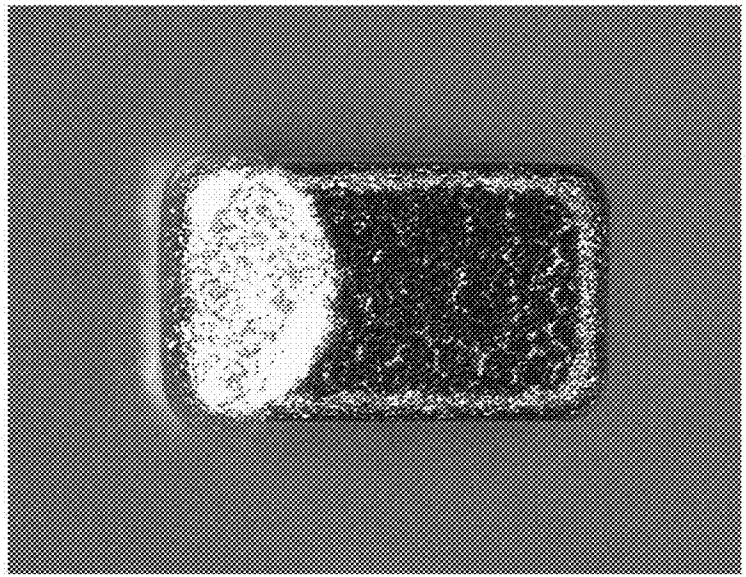
FIG. 9 is a photograph of a side surface of the core.

Each terminal electrode 40 also includes an end surface electrode 42 disposed on the end surface 32 of the corresponding support 22. Each end surface electrode 42 covers a portion (lower portion) of the end surface 32 of the corresponding support 22. Each end surface electrode 42 continues from the bottom surface electrode 41. As illustrated in FIG. 1B, each end surface electrode 42 includes end portions 42*b* in the width direction of the end surface 32 of the corresponding support 22 and a central portion 42*a* in the width direction. Each central portion 42*a* is positioned higher than the corresponding end portions 42*b*. Each end surface electrode 42 also includes an upper end 42*c* having a substantially upward-protruding arc shape. FIG. 9 is a photograph of an enlarged view of the core and the end surface electrode.

The ratio of the height Ta of each central portion 42*a* of the end surface electrode 42 relative to the height Tb of the end portions 42*b* thereof is preferably approximately 1.1 or higher and more preferably approximately 1.2 or higher. In the first embodiment, the ratio of the height is approximately 1.3 or higher. The height of each end surface electrode 42 corresponds to a length, measured in the height direction Td when viewed from the end surface 32 side, between a surface (lower end) of the bottom surface electrode 41 and an end (upper end) of the end surface electrode 42. In particular, the heights Tb of the end portions 42*b* are heights at each of the positions of widthwise ends of a planar portion of the end surface 32. The widthwise ends of the planar portion of the end surface 32 are indicated by dashed lines in FIG. 1B. The core 20 includes outer surfaces (corner portions and ridge portions) rounded into curved round shapes. The rounding is performed, for example, by barrel polishing. The position of the lower end of each bottom surface electrode 41 varies at the curved portions, as a result of which each end surface electrode 42 tends to have height variations. Thus, portions positioned at the widthwise ends of the planar portion of each end surface 32 are considered the end portions 42*b* of each end surface electrode 42. When the widthwise ends of the planar portion of each end surface 32 are poorly defined, portions positioned 50 μm inside from each of the side surfaces 33 and 34 of the support 22 are considered the end portions 42*b* in FIG. 1B.

The height T1 of the inductor 10 is preferably larger than the width W1 thereof (T1>W1). With such dimensions, the end surface electrode 42 can be positioned higher relative to a fixed mounting area, and as a result, connection strength can be increased.

As illustrated in FIG. 1B, each terminal electrode 40 includes side surface electrodes 43 disposed on the respective side surfaces 33 and 34 of the corresponding support 22. As illustrated in FIG. 1A, one of the side surface electrodes 43 of each terminal electrode 40 covers a portion (lower portion) of the side surface 33 of the corresponding support 22. Each side surface electrode 43 continues from the bottom surface electrode 41 and the end surface electrode 42. The height of each side surface electrode 43 gradually increases from a corresponding one of opposing surfaces (inner surfaces 31) of the supports 22 toward the end surface 32 of the corresponding support 22. In other words, an upper side, on the side surface 33 of the support 22, of each terminal electrode 40 is inclined. FIG. 1A illustrates the side surface electrodes 43 on the respective side surfaces 33. The side surface electrode 43 on each side surface 34, illustrated in FIG. 1B, is formed in the same manner.

In the first embodiment, each terminal electrode 40 includes a metal layer and a plating layer on the surface of the metal layer. The metal layer is, for example, a silver (Ag) layer. The plating layer is, for example, a tin (Sn)-plating layer. The metal layer may be a layer of metal such as copper (Cu) or a layer of an alloy of, for example, nickel (Ni)-chromium (Cr) or Ni—Cu. The plating layer may be a Ni-plating layer or a layer of a plurality of types of plating.

Figure 4A:
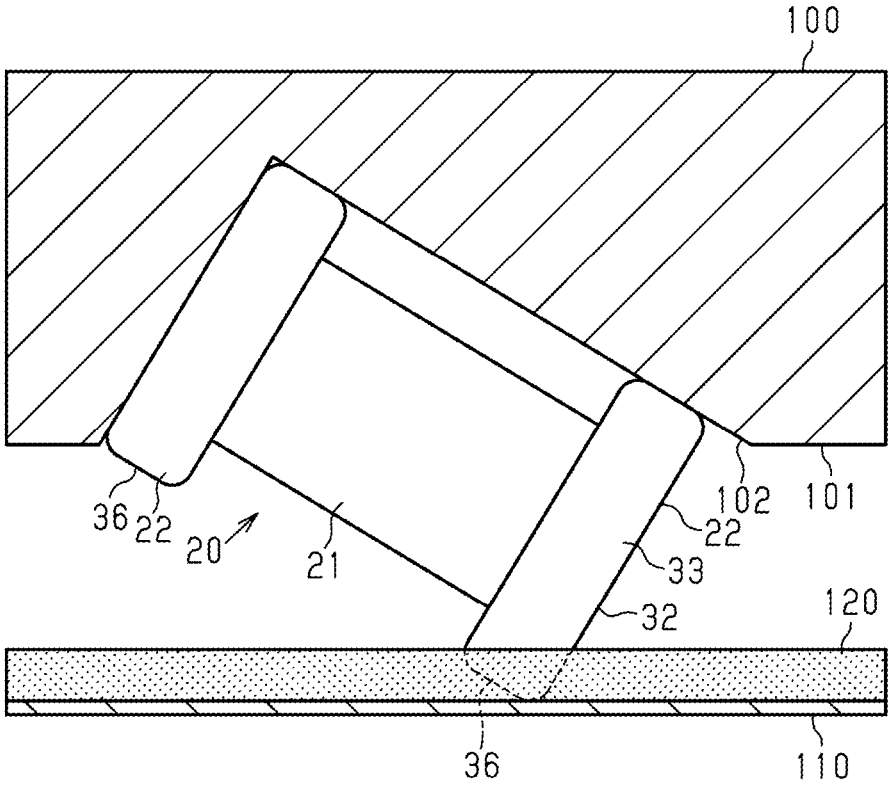
FIGS. 4A and 4B illustrate a terminal electrode forming process.
Figure 4B:
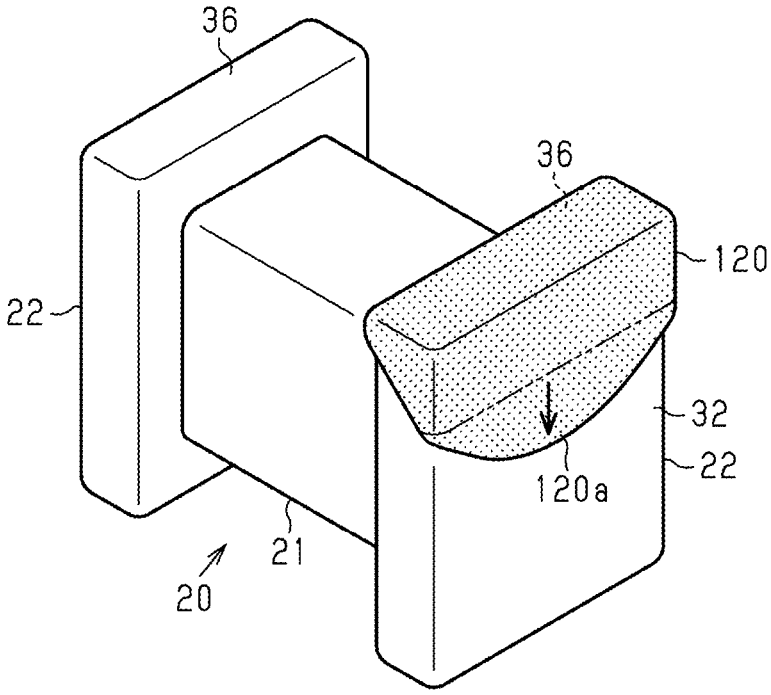

Each terminal electrode 40 is formed, for example, through applying, baking, and plating a conductive paste. FIGS. 4A and 4B illustrate an example of a process of forming the terminal electrode 40.

Firstly, the core 20 is held by a holding tool 100, as illustrated in FIG. 4A. The holding tool 100 includes a holding recess 102 for holding the core 20 such that the axial direction of the core 20 is inclined relative to a lower surface 101 of the holding tool 100. A storage tank 110 stores a conductive paste 120.

The conductive paste 120 is, for example, a Ag paste. The bottom surface 36 of each support 22 of the core 20 is immersed in the conductive paste 120. In this process, the conductive paste 120 adheres to the side surfaces 33 and 34 and the end surface 32 of the support 22 so as to continue from the conductive paste adhering to the bottom surface 36. An upper end of the conductive paste 120 adhering to the end surface 32 is linear at this time.

Next, the core 20 is disposed in such a manner that the bottom surfaces 36 of the supports 22 face upward. For example, the viscosity of the conductive paste 120 is controlled to cause the conductive paste 120 adhering to the end surface 32 to move downward from a position indicated by a two-dot chain line by following the end surface 32.

Moving downward as described above, the conductive paste 120 obtains a lower end 120*a* having a widthwise central portion at the lowest position. The conductive paste 120 in this state is dried. In the same way, the conductive paste 120 is caused to adhere to each support 22 and dried. Then, the conductive paste 120 is baked onto the core 20 to form an electrode film. Consequently, a plating film is formed on a surface of the electrode film, for example, by electroplating to obtain each terminal electrode 40 illustrated in FIGS. 1A and 1B.

The wire 50 is wound around the shaft 21. The two end portions of the wire 50 are electrically connected to the terminal electrodes 40 corresponding thereto. The wire 50 and the terminal electrodes 40 may be connected, for example, by soldering.

The wire 50 includes a core wire having a cross section that is, for example, substantially circular and a covering material that covers a surface of the core wire. The core wire may contain as a main component, for example, a conductive material such as Cu or Ag. As a material for the covering material, for example, an insulating material such as polyurethane or polyester can be used. The diameter of the wire 50 is preferably approximately 14-20 μm and more preferably approximately 15-17 μm. In the first embodiment, the diameter of the wire 50 is approximately 16 μm. An increase in a resistance component can be suppressed due to the wire 50 having a diameter larger than a certain value; protrusion of the wire 50 from the outer shape of the core 20 can be suppressed due to the wire 50 having a diameter smaller than a certain value.

As illustrated in FIG. 1A, the wire 50 includes a winding portion 51 wound around the shaft 21, connected portions 52 connected to the terminal electrodes 40 corresponding thereto, and bridge portions 53 bridging between the winding portion 51 and the connected portions 52. The connected portions 52 are connected to the respective bottom surface electrodes 41 of the terminal electrodes 40, the bottom surface electrodes 41 being disposed on the bottom surfaces 36 of the corresponding supports 22.

The wire 50 is wound around the shaft 21 so as to be spaced from the supports 22 adjacent thereto. In other words, end portions 51*a* and 51*b* of the winding portion 51 are spaced from the respective supports 22. A distance Lb between the end portion 51*a* of the winding portion 51 and one of the supports 22 adjacent to the end portion 51*a* and a distance Lb between the end portion 51*b* of the winding portion 51 and the other support 22 adjacent to the end portion 51*b* are preferably, for example, not larger than approximately five times the diameter of the wire 50, and more preferably not larger than approximately four times the diameter of the wire 50. In the first embodiment, the distance Lb between the wire 50 and each of the supports 22 is not larger than approximately three times the diameter of the wire 50.

The distance between the end portion 51*a* of the winding portion 51 and one of the supports 22 adjacent to the end portion 51*a* and the distance between the end portion 51*b* of the winding portion 51 and the other support 22 adjacent to the end portion 51*b* affect the length of each bridge portion 53. The bridge portions 53 connect the winding portion 51 to the connected portions 52 that are connected to the respective bottom surface electrodes 41 of the terminal electrodes 40 disposed on the respective supports 22. Therefore, when the end portions 51*a* and 51*b* of the winding portion 51 are spaced from the respective supports 22, the length of each of the bridge portions 53 increases and the distance from the respective supports 22 and the shaft 21 increases. In this case, the bridge portions 53 may be damaged or the wire 50 may be broken. Moreover, due to the bridge portions 53, the winding of the wire 50 may loosen and the wire 50 may protrude from the end of the supports 22 and be damaged. The above circumstances are suppressed by setting the distance between the end portions 51*a* and 51*b* of the winding portion 51 and the respective supports 22.

The inductor 10 according to the first embodiment further includes a covering member 60. The covering member 60 is applied on an upper surface of the shaft 21 and on upper surfaces of the supports 22 so as to cover the wire 50 wound around the shaft 21. The covering member 60 has an upper surface 60*a*, which is a plane surface. As a material for the covering member 60, for example, an epoxy resin can be used.

The covering member 60 enables suction to be performed with certainty by a suction nozzle, for example, in mounting the inductor 10 on the circuit board. The covering member 60 also prevents or reduces damaging the wire 50 during suction by the suction nozzle. The inductance (L-factor) of the inductor 10 can be improved by using a magnetic material for the covering member 60. The Q-factor of the inductor 10 can be improved by using a non-magnetic material for the covering member 60 to thereby reduce a loss in magnetism.

Next, effects of the inductor 10 will be described.

Each of the terminal electrodes 40 of the inductor 10 according to the first embodiment includes the end surface electrode 42 formed on the end surface 32 of the core 20 (support 22). Each end surface electrode 42 has the end portions 42*b* in the width direction of the end surface 32 and the central portion 42*a* in the width direction, the central portion 42*a* being positioned higher than the end portions 42*b*. Accordingly, the surface area of each end surface electrode 42 increases compared with when the central portion 42*a* and the end portions 42*b* have the same height. Each end surface electrode 42 increases the surface area of the corresponding terminal electrode 40. The increase in the surface area strengthens the connection with respect to the circuit board, that is, increases the connection strength with respect to the circuit board. The upper end 42*c* of each end surface electrode 42 has a substantially upward-protruding arc shape. The substantially upward-protruding arc shape of each upper end 42*c* further increases the surface area of each terminal electrode 40.

Moreover, when the inductor 10 is connected to the pad of the circuit board by soldering, a solder fillet reaching the height of the central portion 42*a* of each end surface electrode 42 is formed. Here, due to each central portion 42*a* being positioned higher than the end portions 42*b*, each end surface electrode 42 of the inductor 10 can be positioned higher than the solder fillet. Therefore, the small inductor 10 can obtain a sufficient connection strength with respect to the circuit board as the mounting object. The connection strength of the inductor 10 is, for example, approximately 5.22 N.

The height T1 of the inductor 10 according to the first embodiment is larger than the width W1 thereof (T1>W1). Therefore, each end surface electrode can be positioned higher relative to the fixed mounting area, and as a result, the connection strength can be increased.

Each terminal electrode 40 according to the first embodiment is effective for ensuring inductance in the inductor 10. In other words, the magnetic flux generated at the shaft 21 of the core 20 due to the wire 50 forms so as to flow out from the shaft 21 and return, via one of the supports 22, through the air, via the other support 22, to the shaft 21. In the inductor 10 according to the first embodiment, the end portions 42*b* and the side surface electrodes 43 continuing to the end portions 42*b* are positioned lower than the corresponding central portion 42*a*. Thus, at most parts of the side surfaces 33 and 34 of the supports 22 and at most parts of the ridge portions between the side surfaces 33 and 34 and the end surfaces 32, the terminal electrodes 40 do not obstruct the magnetic flux. Therefore, a decrease in the total amount of the magnetic flux is suppressed. The decrease in the total amount of the magnetic flux leads to a decrease in the inductance; thus, it is not possible to obtain a desired inductance (inductance according to a design value of the core). Accordingly, the inductor 10 according to the first embodiment, which suppresses the decrease in the total amount of the magnetic flux, can improve efficiency of acquiring inductance. The inductance of the inductor 10 is, for example, approximately 560 nH with respect to an input signal having a frequency of approximately 10 MHz. Because of the terminal electrodes 40 that do not obstruct the magnetic flux at most parts of the ridge portions, as described above, generation of an eddy-current loss in the terminal electrodes 40 is also reduced. Thus, a decrease in the Q-factor can be also suppressed.

Each terminal electrode 40 includes the side surface electrodes 43 on the respective side surfaces 33 and 34 of the corresponding supports 22. Each side surface electrode 43 has a height gradually increasing from a corresponding one of opposing surfaces (inner surfaces 31) of the supports 22 toward the end surface of the supports 22 corresponding thereto. In other words, each of the side surface electrodes 43 is positioned lower on the side of the inner surface 31 than on the side of the end surface 32, which prevents solder from easily interfering with the wire 50 and the shaft 21 of the inductor, when the inductor is mounted, even when the height of the end surface electrode 42 is increased.

As described above, according to the first embodiment, the following effects are exhibited.

(1-1) The inductor 10 includes the core 20, the pair of terminal electrodes 40, and the wire 50. The core 20 includes the shaft 21 and the pair of supports 22. The shaft 21 has a substantially rectangular parallelepiped shape. The supports 22 are connected to the respective end portions of the shaft 21. The supports 22 support the shaft 21 so as to be parallel to the mounting object (circuit board). The pair of supports 22 is integral with the shaft 21.

Each of the terminal electrodes 40 includes the end surface electrode 42 formed on the end surface 32 of the support 22. Each end surface electrode 42 includes the end portions 42*b* in the width direction of the end surface 32 and the central portion 42*a* in the width direction, the central portion 42*a* being positioned higher than the end portions 42*b*. Each end surface electrode 42 increases the surface area of the respective terminal electrode 40. The increase in the surface area strengthens the connection with respect to the circuit board, that is, increases the connection strength with respect to the circuit board. Therefore, the small inductor 10 can obtain a sufficient connection strength with respect to the circuit board as the mounting object, that is, can suppress a decrease in the connection strength. Each end surface electrode 42 has the upper end 42*c* having the substantially upward-protruding arc shape. The substantially upward-protruding arc shape can further increase the surface area of each end surface electrode 42, that is, the surface area of each terminal electrode 40.

(1-2) The inductor 10 has the height T1 larger than the width W1 (T1>W1). Therefore, each end surface electrode can be positioned higher relative to the fixed mounting area, and as a result, the connection strength can be increased.

(1-3) Each terminal electrode 40 includes the side surface electrodes 43 that cover lower end portions of the side surfaces 33 and 34 of the respective support 22. The magnetic flux generated at the shaft 21 of the core 20 due to the wire 50 forms so as to flow out from the shaft 21 and return, via one of the supports 22, through the air, via the other support 22, to the shaft 21. The inductor 10 according to the first embodiment includes the end portions 42*b* and the side surface electrodes 43 continuing to the end portions 42*b*, the end portions 42*b* and the side surface electrodes 43 being positioned lower than the corresponding central portion 42*a*. Thus, at most parts of the side surfaces 33 and 34 of the supports 22 and most parts of the ridge portions and the corner portions between the side surfaces 33 and 34 and the end surfaces 32, the terminal electrodes 40 do not obstruct the magnetic flux. Therefore, a decrease in the total amount of the magnetic flux is suppressed. The decrease in the total amount of the magnetic flux leads to a decrease in inductance. Thus, it is not possible to obtain a desired inductance (inductance according to a design value of the core). Accordingly, the inductor 10 according to the first embodiment can improve the efficiency of acquiring inductance by suppressing the decrease in the total amount of the magnetic flux. Because of the terminal electrodes 40 that do not obstruct the magnetic flux at most parts of the ridge portions of the supports 22, generation of the eddy-current loss in the terminal electrodes 40 is also reduced. Thus, the decrease in the Q-factor can also be suppressed.

Second Embodiment

A second embodiment will be described below.

Note that, in the second embodiment, components the same as those in the first embodiment have reference characters the same as those in the first embodiment, and a part or all of a description of such components will be omitted.

Figure 5B:
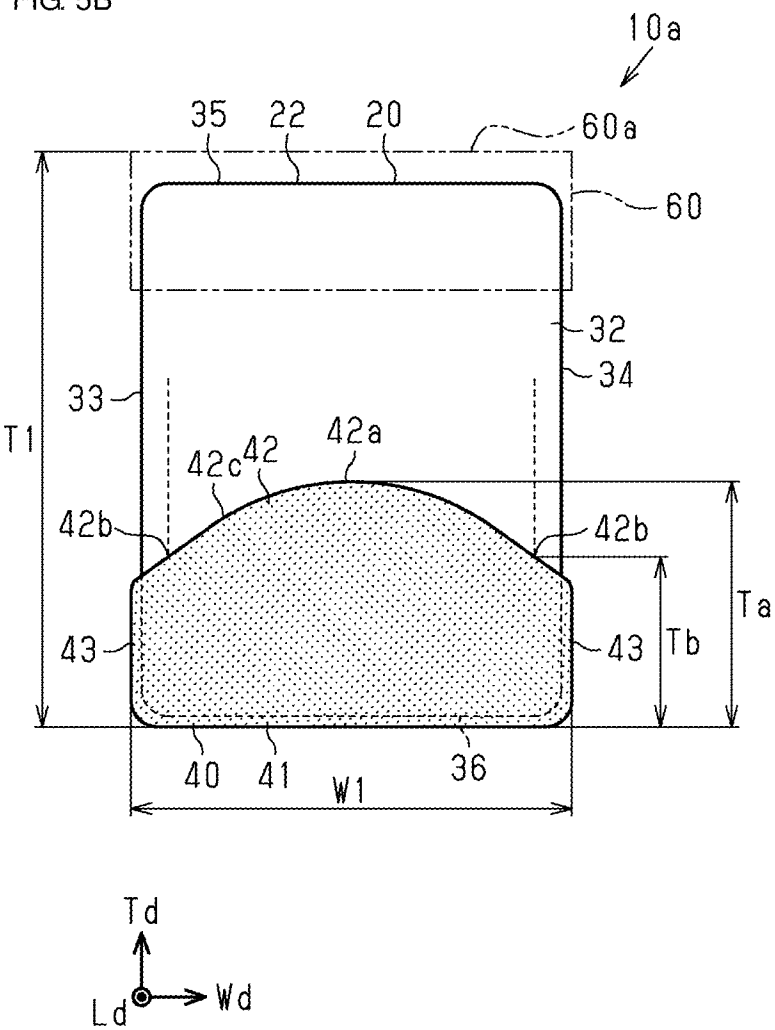
FIG. 5B is an end view of the inductor.
Figure 5A:
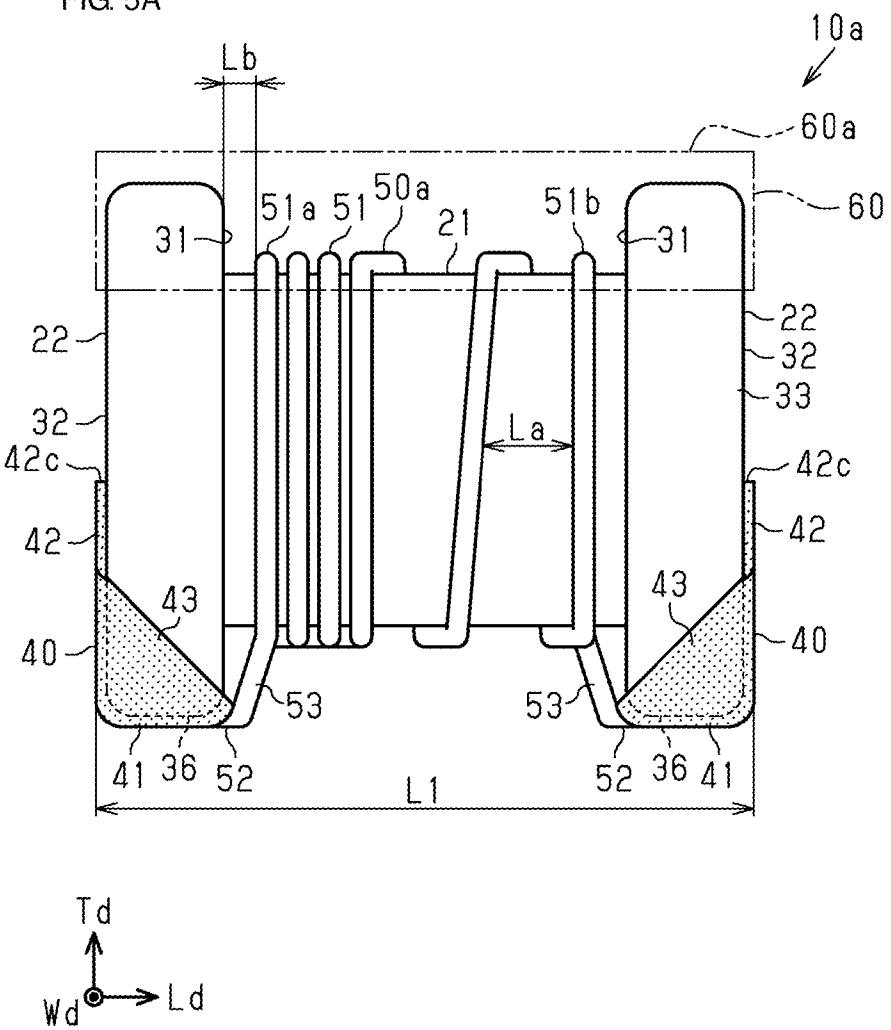
FIG. 5A is a front view of an inductor according to a second embodiment.
Figure 6:
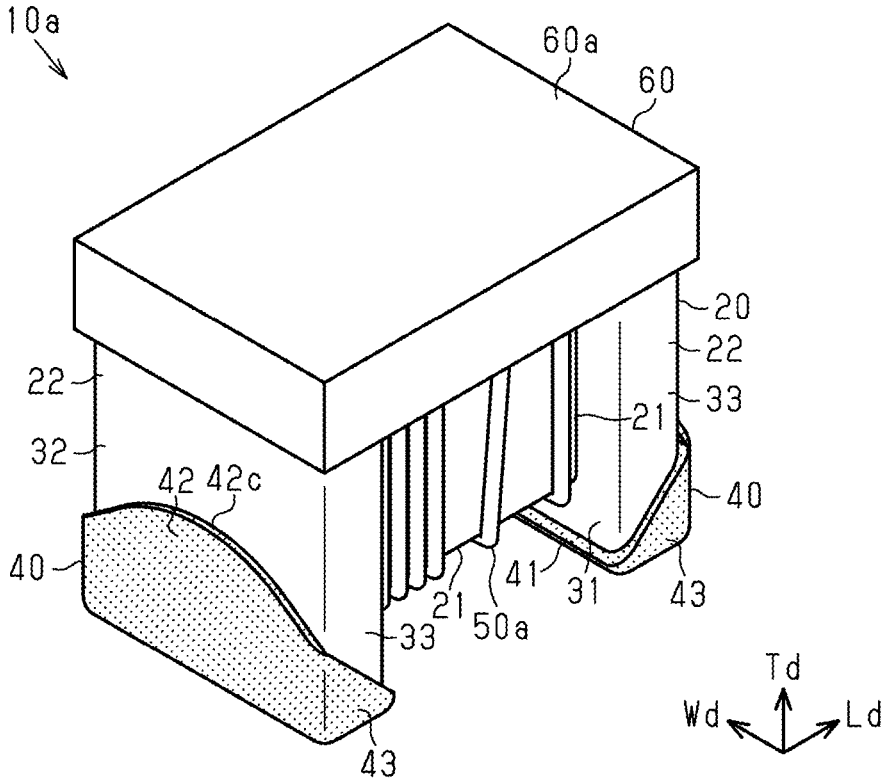
FIG. 6 is a perspective view of the inductor according to the second embodiment.

An inductor 10*a* illustrated in FIGS. 5A and 5B, and FIG. 6, is a surface mount inductor to be mounted on, for example, a circuit board. The inductor 10*a* is applicable to various devices, including portable electronic devices (mobile electronic devices) such as smartphones and wrist-worn mobile electronic devices (for example, a smartwatch).

The inductor 10*a* according to the second embodiment includes a core 20, a pair of terminal electrodes 40, and a wire 50*a*. The core 20 includes a shaft 21 and a pair of supports 22. The shaft 21 has a substantially rectangular parallelepiped shape. The supports 22 are connected to respective end portions of the shaft 21. The supports 22 support the shaft 21 so as to be parallel to a mounting object (circuit board). The pair of supports 22 is integral with the shaft 21.

The terminal electrodes 40 are disposed on the respective supports 22. The wire 50*a* is wound around the shaft 21. The wire 50*a* is the same as the wire 50 in the above-described first embodiment. The wire 50*a* wound around the shaft 21 forms a single layer on the shaft 21. Two end portions of the wire 50*a* are connected to the terminal electrodes 40 corresponding thereto. The inductor 10*a* is a wire-wound inductor.

As illustrated in FIG. 5A, the wire 50*a* includes a winding portion 51 wound around the shaft 21, connected portions 52 connected to the terminal electrodes 40 corresponding thereto, and bridge portions 53 bridging between the winding portion 51 and the connected portions 52. The connected portions 52 are connected to the respective bottom surface electrodes 41 of the terminal electrodes 40, the bottom surface electrodes 41 being formed on the bottom surfaces 36 of the supports 22.

The winding portion 51 includes at least one region in which turns (one turn is a turn of the winding portion 51 wound around the shaft 21) adjacent to each other in the axial direction of the shaft 21 are spaced from each other by a distance larger than or equal to a predetermined value. The predetermined value is preferably, for example, larger than or equal to approximately 0.5 times the diameter of the wire 50*a*, and more preferably larger than or equal to approximately one times the diameter of the wire 50*a*. In the second embodiment, the distance La, which is indicated by the left right arrow in FIG. 5A, between turns of the wire is larger than or equal to approximately twice the diameter of the wire 50*a*. That is, the winding portion 51 according to the second embodiment includes at least one region in which adjacent turns of the wire 50*a* are spaced from each other by a distance larger than or equal to approximately twice the diameter of the wire 50*a*.

In the winding portion 51, parasitic capacitance is generated between turns adjacent to each other in the axial direction of the shaft 21. The value of the parasitic capacitance is determined according to the distance between adjacent two turns of the wire 50. Therefore, increasing the distance between adjacent turns reduces the value of the parasitic capacitance; in other words, increasing the distance between the adjacent turns can reduce the influence of the parasitic capacitance and suppress a decrease in a self-resonance frequency (SRF).

The inductor 10*a* is a wire-wound inductor. The inductor 10*a* according to the second embodiment has electrical characteristics such that an impedance is substantially 500Ω or higher with respect to an input signal having a frequency of approximately 3.6 GHz. The impedance of the inductor 10*a* is preferably approximately 300Ω or higher with respect to an input signal having a frequency of approximately 1.0 GHz. The impedance is preferably approximately 400Ω or higher with respect to an input signal having a frequency of approximately 1.5 GHz, more preferably approximately 450Ω or higher with respect to an input signal having a frequency of approximately 2.0 GHz, and further more preferably approximately 500Ω or higher with respect to an input signal having a frequency of approximately 4.0 GHz. Ensuring impedance higher than or equal to one of such certain values at each of the specific frequencies achieves, for example, noise removal (choke), resonance (bandpass), and impedance matching at these frequencies.

The inductance of the inductor 10*a* is preferably approximately 40-70 nH. With an inductance of approximately 40 nH or higher, an impedance higher than a certain value can be ensured. With an inductance of approximately 70 nH or lower, a high SRF can be obtained. In the second embodiment, the inductance of the inductor 10*a* is, for example, approximately 60 nH. Note that the inductance referred herein is an inductance with respect to an input signal having a frequency of approximately 10 MHz.

The SRF of the inductor 10*a* is preferably approximately 3.0 GHz or higher, more preferably approximately 3.2 GHz or higher, and further more preferably approximately 3.4 GHz or higher. The inductor 10*a* according to the second embodiment has an SRF of approximately 3.6 GHz or higher. Having such an SRF, the inductor 10*a* can function as an inductor for high frequencies.

Next, effects of the inductor 10*a* will be described.

Figure 7:
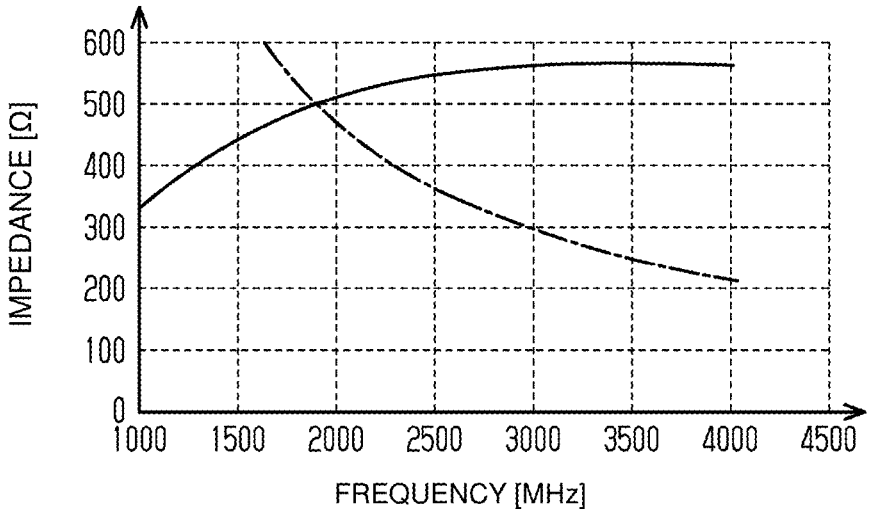
FIG. 7 is a graph of frequency-impedance characteristics of the inductor according to the second embodiment.

FIG. 7 is a graph of frequency-impedance characteristics. In FIG. 7, the solid line indicates the characteristics of the inductor 10*a* according to the second embodiment, and the one-dot chain line indicates the characteristics of an inductor in a comparative example.

The inductor in the comparative example includes a core having the same size and shape as those of the core 20 of the inductor 10*a* according to the second embodiment and includes a wire having the same thickness as that of the wire 50*a* according to the second embodiment. The wire is densely wound around the core. In other words, the inductor in the comparative example includes, at a shaft of the core, a winding portion formed by the wire wound in an axial direction of the shaft such that turns thereof are adjacent to each other. The inductor of the comparative example has an inductance of, for example, approximately 560 nH and an SRF of approximately 1.5 GHz or less.

The impedance of the inductor of the comparative example decreases as the frequency of an input signal increases. In general, a wire-wound inductor functions mainly as a capacitive element at a frequency higher than the SRF thereof. Thus, the impedance decreases, as is in the inductor (SRF: 1.5 GHz) of the comparative example.

In contrast, the inductor 10*a* according to the second embodiment shows an impedance of approximately 400Ω or higher with respect to an input signal having a frequency of approximately 1.5 GHz or higher. The inductor 10*a* according to the second embodiment shows an impedance of approximately 500Ω or higher with respect to an input signal having a frequency of approximately 2.0 GHz or higher, which is in agreement with the fact that the SRF of the inductor 10*a* according to the embodiment is approximately 3.6 GHz.

As described above, the second embodiment provides the following effects in addition to the above-described effects of the first embodiment.

(2-1) The inductor 10*a* includes the core 20, the pair of terminal electrodes 40, and the wire 50*a*. The core 20 includes the shaft 21 and the pair of supports 22. The shaft 21 has the substantially rectangular parallelepiped shape. The supports 22 are connected to the respective end portions of the shaft 21. The supports 22 support the shaft 21 so as to be parallel to the mounting object (circuit board). The pair of supports 22 is integral with the shaft 21.

The terminal electrodes 40 are formed on the respective supports 22. The wire 50*a* is wound around the shaft 21. The wire 50*a* wound around the shaft 21 forms a single layer on the shaft 21. The two end portions of the wire 50*a* are connected to the terminal electrodes 40 corresponding thereto. The inductor 10*a* is a wire-wound inductor. The inductor 10*a* according to the second embodiment has electrical characteristics such that the impedance is approximately 500Ω or higher with respect to an input signal having the frequency of approximately 3.6 GHz. Accordingly, the second embodiment can provide the inductor 10*a* that shows a desired impedance at high frequencies.

The first and second embodiments described above may be carried out in the following mode.

In each embodiment, the shape, illustrated for example in FIG. 1A, of the core 20 may be varied, as appropriate.

Figure 8:
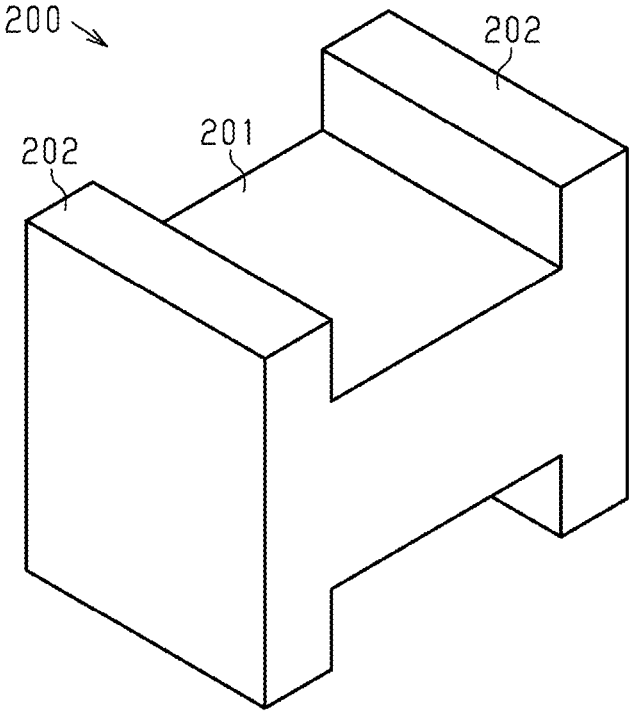
FIG. 8 is a schematic perspective view of a core in a modification.

A core 200 illustrated in FIG. 8 includes a shaft 201 of a substantially rectangular parallelepiped shape and supports 202 on respective end portions of the shaft 201. Each of the supports 202 has the same width as that of the shaft 201 and protrudes upward and downward from the shaft 201. In other words, the core 200 has side surfaces of an H-shape. Note that the core 200 illustrated in FIG. 8 is an example, and the shapes of the shaft 201 and the supports 202 can be varied, as appropriate.

In the first embodiment, the shape, illustrated in FIG. 1A, of the covering member 60 may be varied, as appropriate. For example, the covering member 60 may have a shape that covers, between the supports 22, the wire 50 on an upper part of the shaft 21. The covering member 60 may have a shape that covers the entire winding portion 51 of the wire 50. The covering member 60 may be omitted. The same applies in the second embodiment.

The structures of the inductors 10 and 10*a* according to the first and second embodiments may be varied, optionally selected, and combined, as appropriate, to obtain an inductor of a different structure. For example, in the second embodiment, the structure of the inductor 10*a* according to the second embodiment is not the only structure to achieve an inductor that shows an impedance of approximately 500Ω or higher with respect to an input signal having a frequency of approximately 3.6 GHz. Such a characteristic can be obtained by varying, optionally selecting, and combining, as appropriate, the structures of the inductors 10 and 10*a*.

Technical concepts perceivable from the first and second embodiments will be described below.

(Note 1) An inductor including a core that includes a columnar shaft and a pair of supports on respective end portions of the shaft; a terminal electrode disposed on each support; and a wire wound around the shaft and having two end portions connected to the terminal electrodes corresponding thereto on the supports, wherein an impedance is approximately 500Ω or higher with respect to an input signal having a frequency of approximately 3.6 GHz.

(Note 2) The inductor described in Note 1, wherein the width of the inductor, including the terminal electrodes, in a direction that is orthogonal to a first direction in which the shaft extends and is parallel to a circuit board on which the inductor is mounted via the terminal electrodes is approximately 0.36 mm or less.

(Note 3) The inductor described in Note 2, wherein the width of the inductor, including the terminal electrodes, in the direction that is orthogonal to the first direction, in which the shaft extends, and is parallel to the circuit board on which the inductor is mounted via the terminal electrodes is approximately 0.33 mm or less.

(Note 4) The inductor described in Note 3, wherein the width of the inductor, including the terminal electrodes, in the direction that is orthogonal to the first direction, in which the shaft extends, and is parallel to the circuit board on which the inductor is mounted via the terminal electrodes is approximately 0.30 mm or less.

(Note 5) The inductor described in any one of Notes 1 to 4, wherein the shaft has a section orthogonal to the first direction, in which the shaft extends, and each support has a section orthogonal to the first direction, the section of the shaft having an area of approximately 35%-75% of the area of the section of each support.

(Note 6) The inductor described in Note 5, wherein the area of the section of the shaft is approximately 40%-70% of the area of the section of each support.

(Note 7) The inductor described in Note 6, wherein the area of the section of the shaft is approximately 45%-65% of the area of the section of each support.

(Note 8) The inductor described in Note 7, wherein the area of the section of the shaft is approximately 50%-60% of the area of the section of each support.

(Note 9) The inductor described in Note 8, wherein the area of the section of the shaft is approximately 55% of the area of the section of each support.

(Note 10) The inductor described in any one of Notes 1 to 9, wherein an inductance is approximately 40-70 nH.

(Note 11) The inductor described in Note 10, wherein the inductance is approximately 60 nH.

(Note 12) The inductor described in any one of Notes 1 to 11, wherein an impedance is approximately 300Ω or higher with respect to an input signal having a frequency of approximately 1.0 GHz.

(Note 13) The inductor described in Note 12, wherein the impedance is approximately 400Ω or higher with respect to an input signal having a frequency of approximately 1.5 GHz.

(Note 14) The inductor described in Note 13, wherein the impedance is approximately 450Ω or higher with respect to an input signal having a frequency of approximately 2.0 GHz.

(Note 15) The inductor described in Note 14, wherein the impedance is approximately 500Ω or higher with respect to an input signal having a frequency of approximately 4.0 GHz.

(Note 16) The inductor described in any one of Notes 1 to 15, wherein a self-resonance frequency is approximately 3.0 GHz or higher.

(Note 17) The inductor described in Note 16, wherein the self-resonance frequency is approximately 3.2 GHz or higher.

(Note 18) The inductor described in Note 17, wherein the self-resonance frequency is approximately 3.4 GHz or higher.

(Note 19) The inductor described in Note 18, wherein the self-resonance frequency is approximately 3.6 GHz or higher.

(Note 20) The inductor described in any one of Notes 1 to 19, wherein there are turns of the wire adjacent to each other in an axial direction of the shaft and spaced from each other by a distance larger than or equal to approximately 0.5 times the diameter of the wire.

(Note 21) The inductor described in Note 20, wherein there are turns of the wire adjacent to each other in the axial direction of the shaft and spaced from each other by a distance larger than or equal to approximately one times the diameter of the wire.

(Note 22) The inductor described in Note 21, wherein there are turns of the wire adjacent to each other in the axial direction of the shaft and spaced from each other by a distance larger than or equal to approximately twice the diameter of the wire.

(Note 23) The inductor described in any one of Notes 1 to 22, wherein a distance between one of the supports and the wire adjacent to the one support and a distance between the other support and the wire adjacent to the other support are smaller than or equal to approximately five times the diameter of the wire.

(Note 24) The inductor described in Note 23, wherein the distance between the one support and the wire adjacent to the one support and the distance between the other support and the wire adjacent to the other support are smaller than or equal to approximately four times the diameter of the wire.

(Note 25) The inductor described in Note 24, wherein the distance between the one support and the wire adjacent to the one support and the distance between the other support and the wire adjacent to the other support are smaller than or equal to approximately three times the diameter of the wire.

(Note 26) The inductor described in any one of Notes 1 to 25, wherein each terminal electrode includes a bottom surface electrode on a bottom surface of the support corresponding thereto and an end surface electrode on an end surface of the corresponding support, and wherein each end surface electrode includes end portions in a width direction of the end surface and a central portion in the width direction of the end surface, the central portion being positioned higher than the end portions.

(Note 27) The inductor described in Note 26, wherein each end surface electrode includes an upper end having a substantially upward-protruding arc shape.

(Note 28) The inductor described in Note 26 or 27, wherein in each surface electrode, a ratio of a height of the central portion in the width direction of the end surface relative to a height of the end portions in the width direction of the end surface is approximately 1.1 or higher.

(Note 29) The inductor described in Note 26 or 27, wherein in each end surface electrode, the ratio of the height of the central portion in the width direction of the end surface relative to the height of the end portions in the width direction of the end surface is approximately 1.2 or higher.

(Note 30) The inductor described in Note 26 or 27, wherein in each end surface electrode, the ratio of the height of the central portion in the width direction of the end surface relative to the height of the end portions in the width direction of the end surface is approximately 1.3 or higher.

(Note 31) The inductor described in Note 26, wherein each terminal electrode further includes side surface electrodes on respective side surfaces of the corresponding support, and wherein each side surface electrode has a height gradually increasing from a corresponding one of opposing surfaces of the supports toward the end surface of the support corresponding thereto.

(Note 32) The inductor described in any one of Notes 1 to 31, wherein the diameter of the wire is approximately 14-20 μm.

(Note 33) The inductor described in Note 32, wherein the diameter of the wire is approximately 15-17 μm.

(Note 34) The inductor described in Note 33, wherein the diameter of the wire is approximately 16 μm.

(Note 35) An inductor including a core that includes a columnar shaft and a pair of supports on respective end portions of the shaft; a terminal electrode disposed on each support; and a wire wound around the shaft and having two end portions connected to the terminal electrodes corresponding thereto on the supports. The area of a section of the shaft is approximately 55% of the area of a section of each support, wherein an impedance is approximately 500Ω or higher with respect to an input signal having a frequency of approximately 3.6 GHz, and a distance between one of the supports and the wire adjacent to the one support, and a distance between the other support and the wire adjacent to the other support, are smaller than or equal to approximately three times the diameter of the wire.

(Note 36) An inductor including a core that includes a columnar shaft and a pair of supports on respective end portions of the shaft; a terminal electrode disposed on each support; and a wire wound around the shaft and having two end portions connected to the terminal electrodes corresponding thereto on the supports. Each of the terminal electrodes includes a bottom surface electrode on a bottom surface of the support corresponding thereto and an end surface electrode on an end surface of the corresponding support. Each end surface electrode includes end portions in a width direction of the end surface and a central portion in the width direction of the end surface, the central portion being positioned higher than the end portions. Each end surface electrode includes an upper end having a substantially upward-protruding arc shape, wherein a ratio of the height of each central portion in the width direction of the end surface relative to the height of the end portions in the width direction of the end surface is approximately 1.2 or higher, the diameter of the wire is approximately 16 μm, and a self-resonance frequency is approximately 3.6 GHz or higher.

(Note 37) An inductor including a core that includes a columnar shaft and a pair of supports on respective end portions of the shaft; a terminal electrode disposed on each support; and a wire wound around the shaft and having two end portions connected to the terminal electrodes corresponding thereto on the supports. The width of the inductor, including the terminal electrodes, is approximately 0.30 mm or less, wherein an inductance is approximately 60 nH, and there are turns of the wire adjacent to each other in the axial direction of the shaft and spaced from each other by a distance larger than or equal to approximately twice the diameter of the wire.

(Note 38) An inductor including a core that includes a columnar shaft and a pair of supports on respective end portions of the shaft; a terminal electrode disposed on each support; and a wire wound around the shaft and having two end portions connected to the terminal electrodes corresponding thereto on the supports. Each of the terminal electrodes includes a bottom surface electrode on a bottom surface of the support corresponding thereto and an end surface electrode on an end surface of the corresponding support. Each end surface electrode includes end portions in a width direction of the end surface and a central portion in the width direction of the end surface, with the central portion being positioned higher than the end portions. Each end surface electrode includes an upper end having a substantially upward-protruding arc shape, wherein a ratio of the height of each central portion in the width direction of the end surface relative to the height of the end portions in the width direction of the end surface is approximately 1.2 or higher. The width of the inductor, including the terminal electrodes, is approximately 0.30 mm or less, wherein the area of a section of the shaft is approximately 55% of the area of a section of each support, an inductance is approximately 60 nH, an impedance is approximately 500Ω or higher with respect to an input signal having a frequency of approximately 3.6 GHz, and a self-resonance frequency is approximately 3.6 GHz or higher. There are turns of the wire adjacent to each other in the axial direction of the shaft and spaced from each other by a distance larger than or equal to approximately twice the diameter of the wire, wherein a distance between one of the supports and the wire adjacent to the one support and a distance between the other support and the wire adjacent to the other support are smaller than or equal to approximately three times the diameter of the wire, and the diameter of the wire is approximately 16 μm.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor comprising:

a core including a columnar shaft and a support on an end portion of the shaft;

a terminal electrode disposed on the support, the terminal electrode including a bottom surface electrode on a bottom surface of the support, an end surface electrode on an end surface of the support, and a side surface electrode on a side surface of the support, the end surface electrode including an end portion in a width direction of the end surface and a central portion in the width direction of the end surface, the central portion being positioned higher than the end portion, and a maximum height of the central portion of the end surface electrode being higher than a maximum height of the side surface electrode; and a wire wound around the shaft and having an end portion connected to the terminal electrode.

2. The inductor according to claim 1, wherein the end surface electrode includes an upper end having a substantially upward-protruding arc shape.

3. The inductor according to claim 1, wherein in the end surface electrode, a ratio of a height of the central portion in the width direction of the end surface relative to a height of the end portion in the width direction of the end surface is approximately 1.1 or higher.

4. The inductor according to claim 1, wherein in the end surface electrode, a ratio of a height of the central portion in the width direction of the end surface relative to a height of the end portion in the width direction of the end surface is approximately 1.2 or higher.

5. The inductor according to claim 1, wherein in the end surface electrode, a ratio of a height of the central portion in the width direction of the end surface relative to a height of the end portion in the width direction of the end surface is approximately 1.3 or higher.

6. The inductor according to claim 1, wherein:

the side surface electrode has a height gradually increasing from an inner surface of the support toward the end surface of the support.

7. The inductor according to claim 1, wherein a length of the inductor, including the core and the terminal electrode, is approximately 1.0 mm or less, a width of the inductor, including the core and the terminal electrode, is approximately 0.6 mm or less, and a height of the inductor, including the core and the terminal electrode, is approximately 0.8 mm or less.

8. The inductor according to claim 7, wherein the height is larger than the width.

9. The inductor according to claim 2, wherein in the end surface electrode, a ratio of a height of the central portion in the width direction of the end surface relative to a height of the end portion in the width direction of the end surface is approximately 1.1 or higher.

10. The inductor according to claim 2, wherein in the end surface electrode, a ratio of a height of the central portion in the width direction of the end surface relative to a height of the end portion in the width direction of the end surface is approximately 1.2 or higher.

11. The inductor according to claim 2, wherein in the end surface electrode, a ratio of a height of the central portion in the width direction of the end surface relative to a height of the end portion in the width direction of the end surface is approximately 1.3 or higher.

12. The inductor according to claim 2, wherein:

the side surface electrode has a height gradually increasing from an inner surface of the support toward the end surface of the support.

13. The inductor according to claim 3, wherein:

the side surface electrode has a height gradually increasing from an inner surface of the support toward the end surface of the support.

14. The inductor according to claim 4, wherein:

the side surface electrode has a height gradually increasing from an inner surface of the support toward the end surface of the support.

15. The inductor according to claim 5, wherein:

the side surface electrode has a height gradually increasing from an inner surface of the support toward the end surface of the support.

16. The inductor according to claim 2, wherein a length of the inductor, including the core and the terminal electrode, is approximately 1.0 mm or less, a width of the inductor, including the core and the terminal electrode, is approximately 0.6 mm or less, and a height of the inductor, including the core and the terminal electrode, is approximately 0.8 mm or less.

17. The inductor according to claim 3, wherein a length of the inductor, including the core and the terminal electrode, is approximately 1.0 mm or less, a width of the inductor, including the core and the terminal electrode, is approximately 0.6 mm or less, and a height of the inductor, including the core and the terminal electrode, is approximately 0.8 mm or less.

18. The inductor according to claim 4, wherein a length of the inductor, including the core and the terminal electrode, is approximately 1.0 mm or less, a width of the inductor, including the core and the terminal electrode, is approximately 0.6 mm or less, and a height of the inductor, including the core and the terminal electrode, is approximately 0.8 mm or less.

19. The inductor according to claim 5, wherein a length of the inductor, including the core and the terminal electrode, is approximately 1.0 mm or less, a width of the inductor, including the core and the terminal electrode, is approximately 0.6 mm or less, and a height of the inductor, including the core and the terminal electrode, is approximately 0.8 mm or less.

20. The inductor according to claim 6, wherein a length of the inductor, including the core and the terminal electrode, is approximately 1.0 mm or less, a width of the inductor, including the core and the terminal electrode, is approximately 0.6 mm or less, and a height of the inductor, including the core and the terminal electrode, is approximately 0.8 mm or less.

* * * * *